United States Patent [19]

Mouri et al.

[11] Patent Number: 4,552,503

[45] Date of Patent: Nov. 12, 1985

[54] EXCAVATING VEHICLE

[75] Inventors: Akihiko Mouri; Yoshinobu Tabuchi, both of Sakai; Akira Tsuda, Osaka; Masahiro Tsutsumi, Sakai; Kazushige Ikeda, Osaka, all of Japan

[73] Assignee: Kubota, Ltd., Osaka, Japan

[21] Appl. No.: 563,917

[22] Filed: Dec. 21, 1983

[30] Foreign Application Priority Data

Dec. 24, 1982 [JP] Japan ..... 57-234298

[51] Int. Cl.[4] ..... A01B 63/111

[52] U.S. Cl. ..... 414/687; 414/685; 414/680; 172/2; 172/4

[58] Field of Search ..... 414/687, 685, 680, 682; 172/2, 4

[56] References Cited

U.S. PATENT DOCUMENTS

| | | | |
|---|---|---|---|
| 3,698,580 | 10/1972 | Carlson et al. | 414/687 |
| 4,037,519 | 7/1977 | Miller et al. | 172/4 |
| 4,044,838 | 8/1977 | Wooldridge | 172/4 |
| 4,285,268 | 8/1981 | Deckler | 172/2 |
| 4,337,959 | 7/1982 | Bettin et al. | 172/2 |
| 4,389,153 | 6/1983 | Pedersen et al. | 414/687 |
| 4,393,607 | 7/1983 | Hirosawa | 414/687 |
| 4,419,040 | 12/1983 | Pedersen et al. | 414/687 |

*Primary Examiner*—Raymond A. Nelli

*Attorney, Agent, or Firm*—Edwin E. Greigg

[57] ABSTRACT

An excavating vehicle according to the present invention comprises an excavating apparatus rotated by a hydraulic actuator, said excavating apparatus being stopped automatically and smoothly at predetermined positions with a simple operation.

2 Claims, 3 Drawing Figures

EXCAVATING VEHICLE

BACKGROUND OF THE INVENTION (1) Field of the Invention

The present invention relates to an excavating vehicle comprising a swivel base provided with an excavating apparatus, a hydraulic actuator for rotating the swivel base, and a valve for operating the hydraulic actuator.

The excavating apparatus mounted on an excavating vehicle excavates the ground into a ditch or a hole and carries excavated sand to a loading stand of a truck or to a sand discharging place and returns to the excavating place.

Namely, the swivel base where the excavating apparatus is mounted must be driven and stopped correctly and repeatedly at positions making a predetermined angle relative to the vehicle.

(2) Prior Art

According to the prior art, a swivel base with which an excavating apparatus is provided has been driven or stopped by operating a control valve manually in good timing. Therefore, such a control apparatus is disadvantageous in that shocks are given to the excavating vehicle and the hydraulic circuits thereof and discomfort is given to an operator of the vehicle as a result of a big moment of inertia of the swivel base and other apparatuses mounted thereon generated by stops of the swivel base. Such a manual control may close the valve quickly, but cannot operate the valve precisely stop the swivel base at a desired position. In addition to the above described disadvantage, the prior art is also disadvantageous in that a good mechanical skill is required of the operator in stopping the swivel base at a predetermined angle relative to the excavating vehicle and that nerve strain is given to the operator as a result of his repeated operations of stopping the swivel base in good timing.

SUMMARY OF THE INVENTION

The present invention has been made in view of the above described disadvantages of the prior art.

It is therefore an object of the present invention to provide an excavating vehicle which is provided with an excavating apparatus which ensures automatic stops of a swivel base at predetermined positions clockwise or counterclockwise without a skilled operation and with the occurrence of uncomfortable vibration restrained to the excavating vehicle and hydraulic circuits thereof. It is another object of the present invention to provide an excavating apparatus wherein the prior art structure is effectively utilized.

The excavating vehicle according to the present invention comprises an excavating apparatus rotatably mounted on the vehicle, a hydraulic actuator for rotating the excavating apparatus, an electrically operated control valve for changing the operational direction of said hydraulic actuator and for adjusting flow rate of fluid to be supplied with the hydraulic actuator, an operating means for operating the control valve, an electrical sensor means outputting information according to the direction and the amount of operation of the operating means, and a control device for operating the control valve according to the information given by the electrical sensor, the excavating vehicle further comprising:

a position stopping device for predetermining stop positions of the excavating apparatus with respect to the vehicle, a detecting device for detecting positions of the excavating apparatus with respect to the vehicle, and a control apparatus for automatically stopping the excavating apparatus so as to actuate the control valve to reduce flow rate of fluid according to the information given by the devices for predetermining stop positions of the excavating apparatus and the information given by the device for detecting positions of the excavating apparatus when the excavating apparatus is near the predetermined positions. The control apparatus for automatically stopping the excavating apparatus processes the information of predetermined stop positions of the excavating apparatus in the rotation thereof with respect to an excavating vehicle and the information of a starting position of the excavating apparatus detected by the detecting device. As the excavating apparatus approaches a predetermined stop position either clockwise or counterclockwise, the excavating apparatus may be stopped automatically at a predetermined position either clockwise or counterclockwise by reducing flow rate of fluid to be supplied with the hydraulic actuator for actuating the excavating apparatus so as to reduce rotating speed of the excavating apparatus. Accordingly, the excavating apparatus may be stopped at a predetermined position without a skilled operation. Further, since a sudden stop of the excavating apparatus does not occur, the excavating apparatus may be stopped smoothly and correctly by restraining occurrences of uncomfortable vibration.

As described above, the excavating vehicle according to the present invention is simplified in comparison with the construction of the prior art wherein a control valve for adjusting flow rate of fluid is provided for stopping the excavating apparatus, since the excavating vehicle of the present invention is constructed to stop the excavating apparatus automatically at predetermined positions by effectively utilizing the prior art.

The other advantages of the present invention will be more apparent from the following description.

BRIEF DESCRIPTION OF THE DRAWINGS

The drawings illustrate an embodiment of the excavating vehicle according to the present invention in which.

DESCRIPTION OF THE PREFERRED EMBODIMENT

Figure 1:
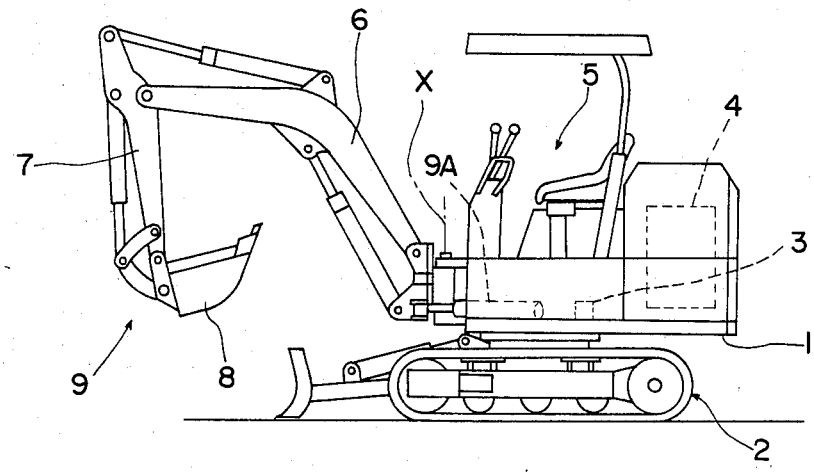
FIG. 1 shows a side view of a backhoe as an example of the excavating vehicle.

FIG. 1 shows an excavating vehicle such as a backhoe with which crawlers (2) are provided. A swivel base (1) to be actuated by a hydraulic motor (3) is rotatably mounted on the vehicle. An engine (4) and an operation cabin (5) are mounted on the swivel base (1). An excavating apparatus (9) comprises a boom (6), an arm (7), and a bucket (8) and is mounted on the swivel base (1) to be rotatably actuated clockwise or counterclockwise by the hydraulic cylinder (9A) around a vertical axis (X).

Figure 2:
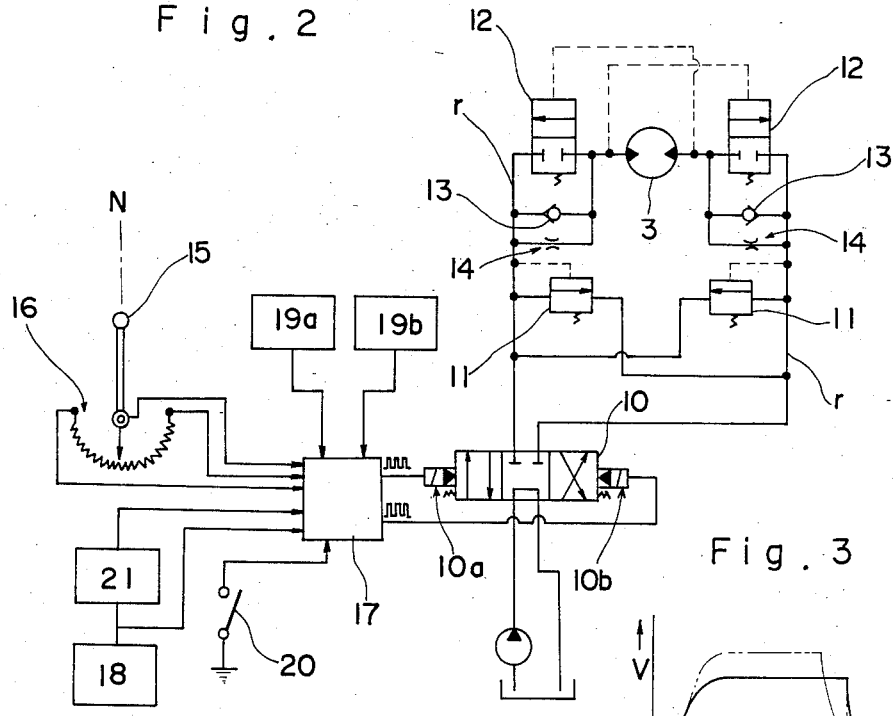
FIG. 2 shows a schematic hydraulic circuit.

As shown in FIG. 2, an electro-magnetic control valve (10) is provided in the hydraulic circuit for changing the rotational direction of the hydraulic motor (3)

adapted to actuate the swivel base (1) and adjust flow rate of fluid to be supplied with the hydraulic motor (3). Each of relief valves (11), (11) acting as the means of cushioning against shocks caused by the hydraulic motor (3), is provided respectively between a pair of flow passages (r), (r) connecting the valve (10) to the hydraulic motor (3). A brake valve is provided at each flow passage (r) and comprises a pilot shaped flow passage (12), a check valve (13), and a throttle valve (14) disposed in parallel to each other. The relief valves (11), (11) have the function of reducing shocks caused by the stop of the swivel base (1). Further, the brake valve has the function of restraining the swivel base (1) from rotating at an undesired high speed caused by inertia generated due to stops of the swivel base (1) without supply of pressure oil.

As shown in FIG. 2, a potentiometer (16) provides means of detecting a position of a manual lever (15) as an operating means relative to a neutral position (N). The manual lever (15) is mounted tiltably clockwise or counterclockwise. The manual lever (15) may then be tilted clockwise or counterclockwise according to the information detected by the potentiometer (16). The swivel base (1) is swiveled counterclockwise when the manual lever (15) is tilted conterclockwise and the swivel base (1) is driven clockwise when the manual lever (15) is tilted clockwise. The bigger an angle which the manual lever makes with the neutral position (N), the faster the swivel base (1) swivels. In order to rotate the excavating apparatus of the backhoe at a desired speed either clockwise or counterclockwise, the control circuit (17) for operating the electro-magnetic hydraulic control valve (10) is provided. The following is a detailed description of the control circuit (17). The control circuit (17) computes the rotational direction of the hydraulic motor (3) and flow rate of fluid supplied with the hydraulic motor (3) according to the information previously memorized in the control circuit (17) and the information from the potentiometer (16) which detects the operated condition of the manual lever (15) as variation of voltage signals. In accordance with the result computed by the control circuit (17), an actuator for counterclockwise rotation (10*a*) or an actuator for clockwise rotation (10*b*) is electrically conducted intermittently by means of pulse signals. Further, the control circuit (17) is constructed to vary repeated frequency of pulse signals in order to change an electrically conducted period per unit time. Furthermore, the information for actuating the control valve (10) is also memorized in the control circuit (17) as described hereunder.

A sensor (18) including a potentiometer is disposed for sensing a position of the swivel base (1) relative to the vehicle. A first predetermining device (19*a*) is disposed for predetermining the standard position of the swivel base (1) to be stopped for excavating works. A second predetermining device (19*b*) is disposed for stopping the swivel base (1) at the predetermined position where the excavated material is discharged. A manual switch (20) is disposed for changing the control circuit (17) from an activated state to inactivated state and vice versa according to the information given by the sensor (18) and the devices (19*a*) and (19*b*). While the manual switch (20) is in activated state, the control valve (10) is automatically changed to the position for decreasing flow rate of fluid with the approach of the swivel base (1) to the predetermined starting or stopping position, thereby stopping the swivel base (1) automatically.

When excavating the ground into a ditch or holes, the excavating apparatus (9) is swiveled repeatedly from the predetermined starting position to the predetermined stopping position, namely, between the position predetermined for excavating the ground and the position predetermined for discharging the material. To start the swivel base (1) from the standard position and to stop the swivel base (1) at the desired position, it is necessary only to operate the manual lever (15) so that the swivel base (1) may be stopped at the desired position. Further, when the swivel base (1) approaches the predetermined stopping position, rotational speeds of the swivel base (1) are automatically reduced, and as a result, the swivel base (1) is smoothly stopped with the occurrence of uncomfortable vibration reduced.

In order to set a timing for actuating the control valve (10) for an automatic stop of the swivel base (1), the control circuit (17) memorizes information to determine the start timing when the swivel base (1) swivels only at a predetermined angle. According to the expected normal speed of the swivel base (1), the manual lever (15) should be operated when the swivel base (1) makes the predetermined angle during rotations thereof relative to the vehicle before arriving at the predetermined stopping position in rotational direction. The control circuit (17) provides a program for automatically correcting the information memorized therein and is constructed such that according to the information given by the device (21) for sensing a rotational speed of the swivel base (1) by calculating signals sensed by the above described sensor (16) for sensing a rotational position of the swivel base (1), the timing of operating the control valve (10) may be varied early as the rotational speed of the swivel base becomes faster.

By virtue of the excavating vehicle according to the present invention, the rotational speed of the swivel base (1) can be reduced even if the rotational speed of the swivel base (1) becomes faster than the normal speed thereof due to gravity when an excavating work is carried out on the inclined ground.

Figure 3:
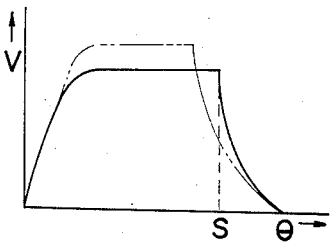
FIG. 3 is a graph showing the relation between positions and rotational speeds of an excavating apparatus.

FIG. 3 is a graph showing the relation between rotational speeds (V) and predetermined stopping positions ($\theta$) of the swivel base (1). The dot and dash line shows that the timing (S) of operating the control valve (10) becomes early in proportion to the increase of the rotational speed of the swivel base (1).

In embodying the present invention, the excavating apparatus (9) may be swung by means of the hydraulic cylinder (9A) relative to the swivel base (1) instead of rotating the swivel base (1) or the excavating apparatus (9) may be rotated relative to the vehicle body if the vehicle is not provided with the swivel base (1).

The present invention may be used for various working vehicles such as a face shovel working vehicle.

A valve operated by a servomotor may also be used as the electrically operated control valve (10). The control mechanism or device for operating the valve and the control device for automatically stopping the swivel base (1) can be varied according to the kind of the control valve (10).

The control device for automatically stopping the swivel base (1) may be used for rotating the excavating apparatus (9) only clockwise or counterclockwise with respect to the predetermined starting position or the stop position.

We claim:

1. An excavating vehicle including a hydraulic actuator and a control system for producing a swivel motion of a swivel base which comprises:

means for moving said vehicle from place-to-place, a swivel base on said means for moving said vehicle, an excavating apparatus on said swivel base, a hydraulic system for operating said actuator drive, said hydraulic system including, a control valve for adjusting a flow rate and direction of flow of a hydraulic fluid supplied to said actuator, a motor-pump for pumping said hydraulic fluid to said control value, swivel base position determining means for setting a predetermined stopping position of said swivel base, detector means for detecting positions of said swivel base, operator position setting means for setting a direction and speed of movement of said swivel base relative to a neutral position, and control means for controlling fluid flow through said control valve, said control means adapted to receive control signals from said operator means, said position setting means and said position detector means which determines a swivel speed of said swivel base and a deceleration timing signal from said operator position setting means which signals are evaluated in said control means and result in an output signal for controlling said control valve, whereby said output signal to said control valve controls the fluid flow rate through said control valve thereby reducing the flow rate in a timed relationship in accordance with swivel speed to slowly stop said swivel base at a desired stop position, the faster the swivel speed, the earlier the output signal is directed to said control valve.

2. An excavator vehicle as defined in claim 1 wherein said control valve comprises an electromagnetic valve including solenoids at respective ends thereof and driven by a pulse signal, and said control means is adapted to transmit to said control valve the flow rate reducing signal in form of a pulse signal of low repetition frequency.

* * * * *